United States Patent [19]

Müller

[11] 4,041,574

[45] Aug. 16, 1977

[54] COILING DEVICE FOR DEPOSITING SLIVER IN CANISTERS

[75] Inventor: Peter Müller, Bremen-Lesum, Germany

[73] Assignee: Fried.Krupp Gesellschaft mit beschrankter Haftung, Essen, Germany

[21] Appl. No.: 611,638

[22] Filed: Sept. 9, 1975

[30] Foreign Application Priority Data

Sept. 14, 1974 Germany ..... 2444020

[51] Int. Cl.[2] ..... B65H 54/80

[52] U.S. Cl. ..... 19/159 R

[58] Field of Search ..... 19/159 R, 157; 242/82

[56] References Cited

U.S. PATENT DOCUMENTS

| | | | |
|---|---|---|---|
| 2,780,841 | 2/1957 | Berker | 19/159 R |
| 2,799,056 | 7/1957 | Carmichael | 19/159 R |
| 2,835,930 | 5/1958 | Selby | 19/159 R |

FOREIGN PATENT DOCUMENTS

| | | | |
|---|---|---|---|
| 1,213,779 | 11/1959 | France | 19/159 R |
| 1,075,831 | 4/1954 | France | 19/159 R |
| 916,976 | 1/1963 | United Kingdom | 19/159 R |
| 236,286 | 2/1970 | U.S.S.R. | 19/159 R |

*Primary Examiner*—Dorsey Newton

*Attorney, Agent, or Firm*—Spencer & Kaye

[57] ABSTRACT

A coiling device for depositing sliver in a canister has a rotary cage having an axis of rotation; a mechanism for rotating the cage; an inlet opening through which the sliver is introduced into the cage; an outlet opening in the cage eccentrically thereof for discharging the sliver in a path orbiting about the cage axis. There is further provided a first calender roll supported in the cage; a drive mechanism connecting the cage with the first calender roll for rotating the first calender roll about its longitudinal axis upon rotation of the cage about the cage axis; a second calender roll supported in the cage on a pivotal shaft mounted in the cage and spaced from the second calender roll. The second calender roll is urged against the first calender roll for generating a clamping force. The second calender roll and the pivotal shaft form part of a pivotal unit. The two rolls constitute a cooperating calender roll pair between the inlet opening and the outlet opening for drawing, by means of the clamping force, the sliver through the inlet opening and advancing it through the outlet opening. The axis of the pivotal shaft is so oriented in the cage that the centrifugal force generated by the rotation of the cage and exerted on the pivotal unit has a sole direction of action which leaves the clamping force unaffected.

2 Claims, 4 Drawing Figures

COILING DEVICE FOR DEPOSITING SLIVER IN CANISTERS

BACKGROUND OF THE INVENTION

This invention relates to a rotating coiling device to deposit sliver — particularly drawing frame sliver or card sliver — into a canister. The coiling device has a rotating cage which is provided with an eccentrically disposed sliver outlet opening and a pair of calender rolls arranged in the cage for advancing the sliver. One roll of the roll pair is rotatably, but otherwise unmovably attached to the cage and is driven thereby. The second roll of the roll pair is supported in such manner in a housing within the cage that the second roll is swingable about an axis and thus displaceable with respect to the driven roll.

There are known coiling devices of the above-outlined type for depositing sliver, wherein the sliver, as it passes through the rolls, is elastically clamped by means of the resiliently supported roll. The swingable roll is rotated by the other roll which is rotatably, but otherwise unmovably supported in the cage. In the known coiling devices the rotary axis of the cage is situated in the zone between the roll shafts. As a result, the resiliently supported roll — by virtue of the centrifugal force generated by the rotation of the cage — executes a pivotal motion, so that the distance between those roll portions which guide the sliver increases, that is, the clamping force exerted on the sliver is decreased. In high-speed coiling devices which have a large cage diameter, the centrifugal force affecting the pivotal roll assumes such high values that the clamping effect on the sliver is changed excessively. Therefore, in known coiling devices, it is not possible to set the clamping force exerted by the calender rolls in such a manner that the coiling device operates in an optimal manner both for high and low drawing speeds of the sliver to be deposited.

SUMMARY OF THE INVENTION

It is an object of the invention to provide an improved coiling device with positively driven calender rolls in which the clamping force exerted on the sliver to be advanced is independent from the rpm of the cage. The coiling device should therefore be designed in such a manner that the drawing speed dependent from the rpm of the cage should be variable even during operation without subsequent adjustment.

This object and others to become apparent as the specification progresses, are accomplished by the invention, according to which, briefly stated, the axis of the pivotal shaft is so oriented in the cage that the centrifugal force generated by the rotation of the cage and exerted on the pivotal unit has a sole direction of action which leaves the clamping force unaffected.

Thus, the essence of the invention resides in the fact that the shaft which carries the pivotal unit is oriented with respect to the cage in such a manner that its position affects the effective direction of the centrifugal force. The above-defined orientation of the shaft is different from that of prior art coiling devices.

According to a preferred embodiment of the invention, the position of the pivotal shaft is characterized by the arrangement according to which the shortest distance between the center of gravity of the pivotal unit and the rotary axis of the cage extends parallel to the axis of the pivotal shaft. In this arrangement the centrifugal force affecting the pivotal unit has no component which causes an alteration of the clamping force.

In accordance with another preferred embodiment of the invention, an effect of the centrifugal force on the clamping force is avoided by an arrangement according to which the straight line constituting the shortest distance between the center of gravity of the pivotal unit and the rotary axis of the cage intersects the axis of the pivotal shaft.

DESCRIPTION OF THE PREFERRED EMBODIMENTS

Figure 1A:
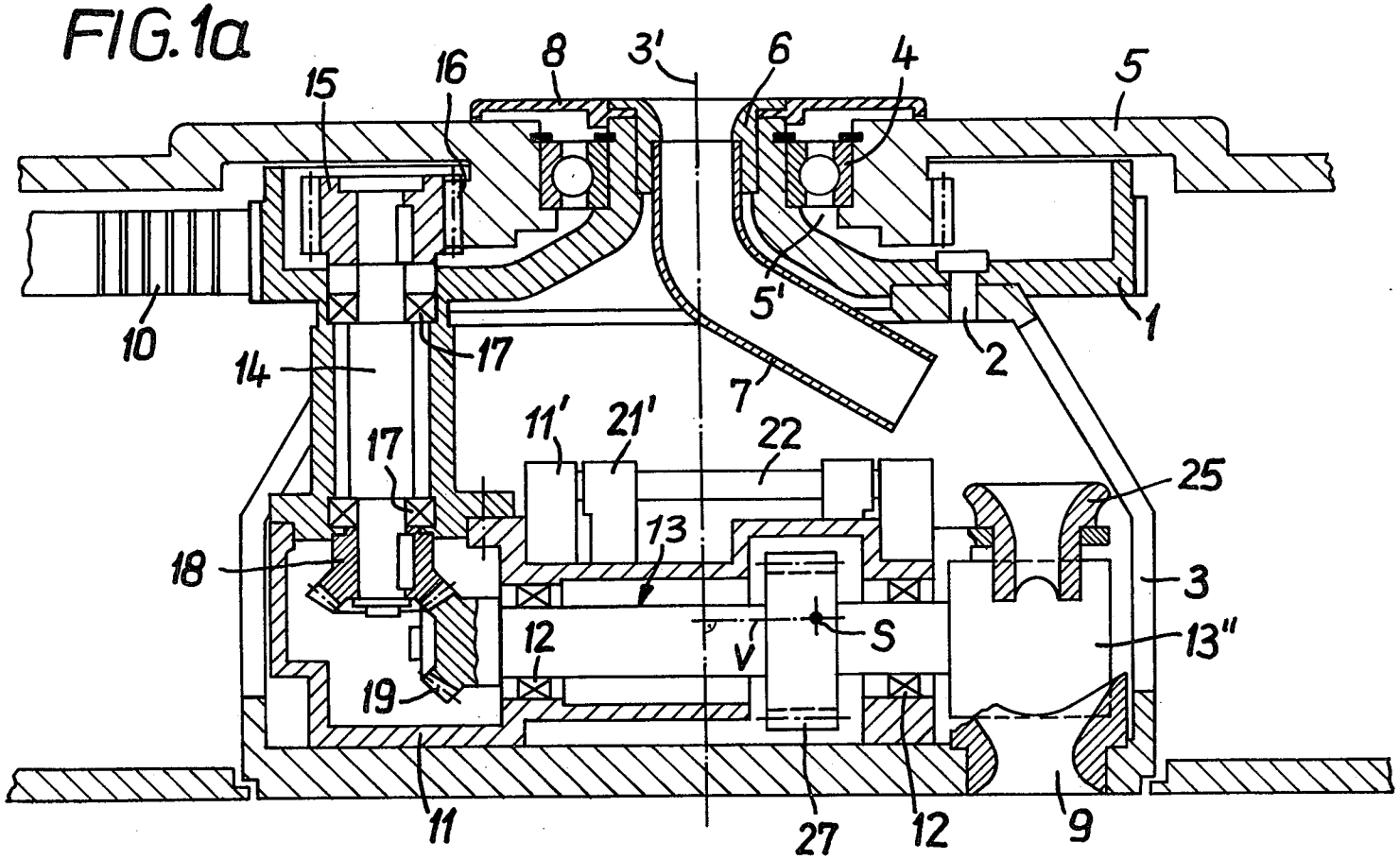
FIG. 1*a* is an axial sectional view of a coiling device according to a preferred embodiment of the invention.

Turning now to FIG. 1*a*, a cage 3 to which there is concentrically affixed — by means of screws 2 — a peripherally toothed drive wheel 1, is supported in a stationary frame 5 by means of a bearing 4.

In the hub of the drive wheel 1 there is secured an angularly bent tube 7 having at its upper end an inlet funnel 6. The assembly 6,7 constitutes the inlet for the sliver to be deposited. The bearing bore 5' provided in the frame 5 for the bearing 4 is covered by a closure disc 8 clamped between a radially flared portion of the funnel structure 6 and a radial terminal face of the hub of the drive wheel 1. The cage 3 which is provided with an eccentrically located sliver outlet 9, is driven by means of a toothed belt 10 meshing with the teeth of the drive wheel 1.

To the cage 3, in the inside thereof, there is affixed a housing 11 which carries spaced bearings 12. The latter rotatably support a calender roll generally indicated at 13 which, at one end, has a bevel gear 19. A drive shaft 14 is supported in the cage 3 by bearings 17 and has, at one end, a bevel gear 18 meshing with the bevel gear 19 of the roll 13. At the other end of the shaft 14 there is provided a pinion 15 which meshes with a ring gear 16 integral with the frame 5. It is seen from FIG. 1*a* that as the belt 10 rotates the drive wheel 1 and thus the cage 3, the pinion 15 orbits about the ring gear 16 and as a result, the calender roll 13 is rotated by the shaft 14 and the bevel gears 18, 19.

Figure 1B:
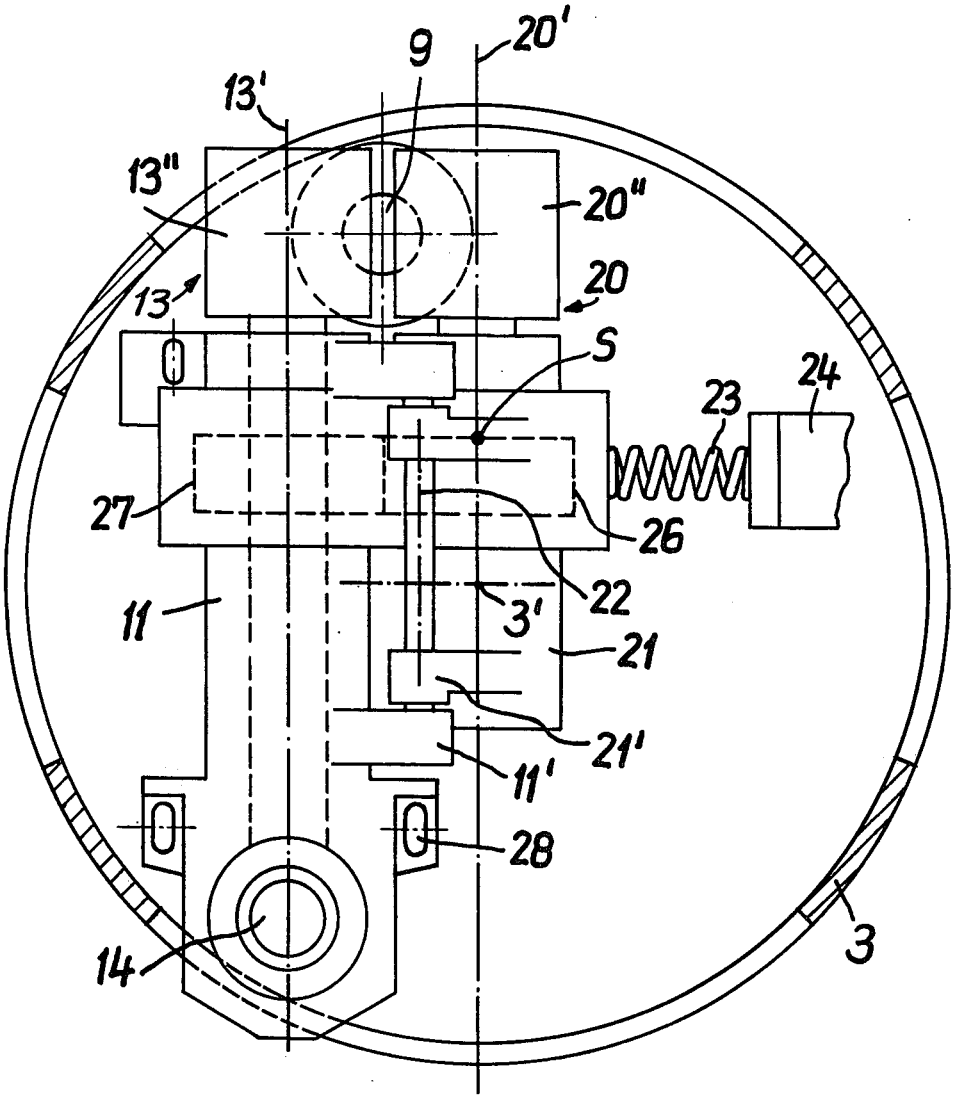
FIG. 1*b* is a sectional view taken along a plane normal to the rotary axis of the coiling device and passing through the cage thereof.

Also referring now to FIG. 1*b*, with the calender roll 13 there cooperates another calender roll generally indicated at 20 which is supported in a housing 21. The housing 21 is supported on a pivotal shaft 22 by means of carrier arms 21'. The pivotal shaft 22 is, in turn, rigidly connected with the housing 11 of the driven calender roll 13 by means of carrier arms 11'. The housing 21 laterally supports a cylindrical coil spring 23, the bias of which is adjustable by shifting a spring support 24 perpendicularly to the rotary axis 20' of the roll 20.

The calender roll 20 — together with the housing 21 — is urged to pivot, by means of the spring 23, in the direction of the calender roll 13, whereby a clamping force is exerted on the sliver disposed between, and advanced by the cooperating clamping portions 13'' and 20″ of the calender rolls 13 and 20, respectively. The roll 20 is driven by the roll 13 by means of meshing gears 26 and 27, affixed to the rolls 20 and 13, respectively.

Above the clamping zone of the calender rolls there is arranged an inlet funnel 25 which, as well seen in FIG. 1*a*, is rigidly connected with the cage 3 by a portion of the housing 11.

The position of the housing 11 and thus the position of the rotary axis 13′ of the calender roll 13 with respect to the cage 3 is adjustable by securing elements (not shown) projecting into longitudinal slots 28 provided in the housing 11.

In accordance with the invention, the center of gravity S of the pivotal unit — which is formed essentially of the roll 20 having a clamping zone 20′, the housing 21, the carrier arms 21′ and the gear 26 — assumes a position in which the line V constituting the shortest distance between the center of gravity S and the rotary axis 3′ of the cage 3 is parallel to the axis of the pivotal shaft 22. By virtue of this arrangement it is accomplished that the centrifugal force generated by the rotation of the cage 3 and exerted on the pivotal unit has no component which can cause an alteration of the bias of the spring 23.

By virtue of the predetermined position of the center of gravity S of the pivotal unit as defined above, the rotary axis 13′ of the roll 13 is eccentrically arranged with respect to the cage 3, as it may be observed in FIG. 1*b*.

Figure 2A:
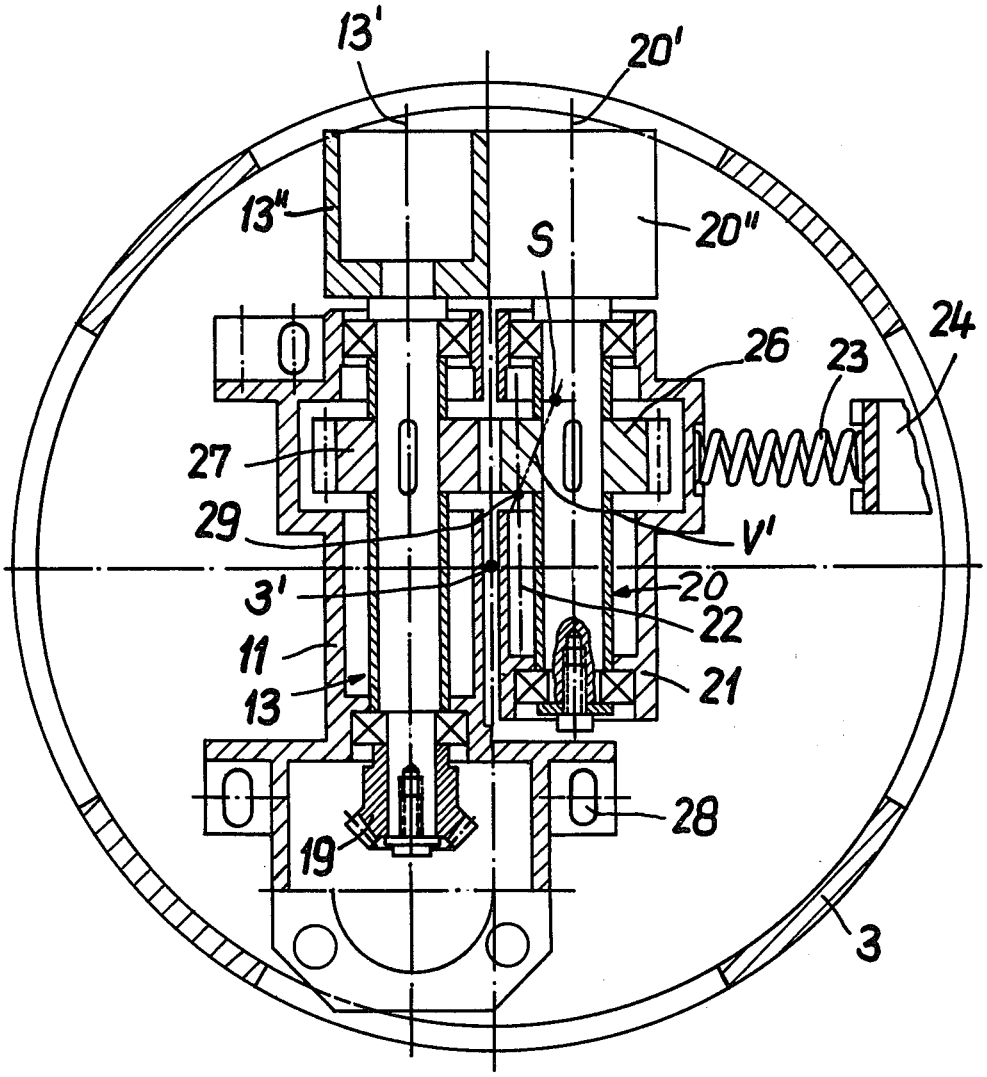
FIG. 2*a* is a sectional view similar to FIG. 1*b* and illustrates another embodiment of the invention.
Figure 2B:
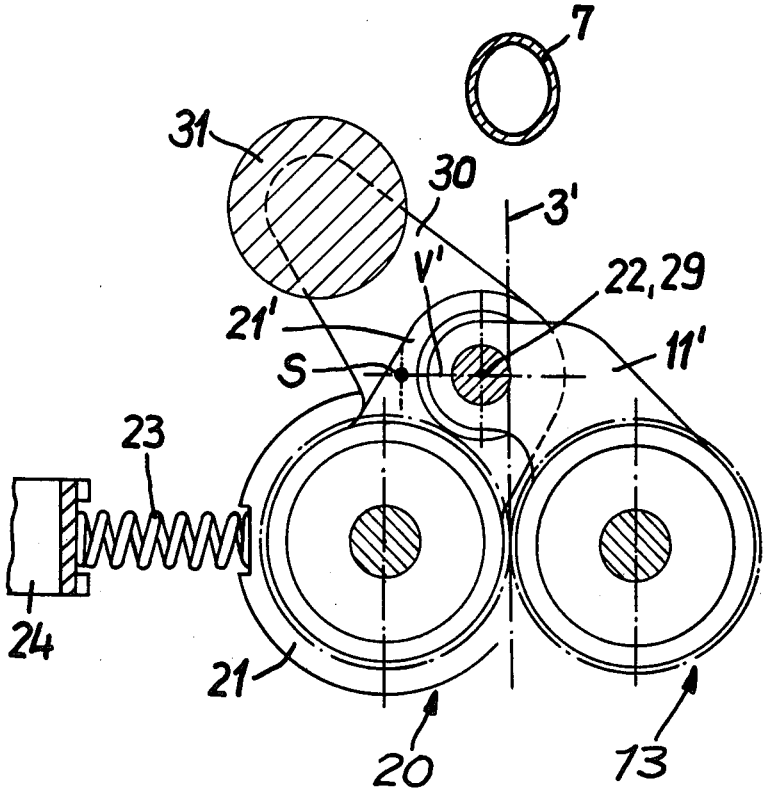
FIG. 2*b* is a partial sectional view in a plane parallel to the rotary axis of the coiling device and shows the calender rolls in the zone of a gear pair driving the pivotal calender roll.

In accordance with the embodiment shown in FIGS. 2*a*, 2*b*, the calender rolls 13 and 20 are arranged in such a manner that the line of contact between the cooperating clamping portions 13″ and 20″ intersects the axis of rotation 3′ of the rotary cage 3. The pivotal unit (components 20, 21 and 26) is designed and arranged in such a manner that the connecting line V′ constituting the shortest distance between the center of gravity S and the rotary axis 3′, intersects the axis of the pivotal shaft 22 in point 29 as seen in FIG. 2*a*. In this embodiment the pivotal shaft 22 is disposed horizontally and the housing 21 is connected with a counterweight 31 by means of a lever 30 attached to the housing 21 as shown in FIG. 2*b*. The lever 30 as well as the counterweight 31 form part of the pivotal unit which has a center of gravity S.

It is to be understood that the invention, by dimensioning accordingly the required counterweight 31, may find application in coiling devices which have a vertically or obliquely arranged pivotal shaft 22.

It will be understood that the above description of the present invention is susceptible to various modifications, changes and adaptations, and the same are intended to be comprehended within the meaning and range of equivalents of the appended claims.

What is claimed is:

1. In a coiling device for depositing sliver in a canister including a rotary cage having an axis of rotation; means for rotating the cage; means defining an inlet opening through which the sliver is introduced into the cage; means defining an outlet opening in the cage eccentrically thereof for discharging the sliver in a path orbiting about the cage axis; a first calender roll supported in the cage; drive means connecting the cage with the first calender roll for rotating the first calender roll about its longitudinal axis upon rotation of the cage about the cage axis; a second calender roll supported in the cage on a pivotal shaft mounted in the cage and spaced from the second calender roll; means for urging the second calender roll against the first calender roll for generating a clamping force; means for driving the second calender roll about its longitudinal axis; the second calender roll and the pivotal shaft forming part of a pivotal unit having a center of gravity; the two rolls constituting a cooperating calender roll pair between the inlet opening and the outlet opening for drawing, by means of the clamping force, the sliver through the inlet opening and advancing it through the outlet opening; the roll pair moving with the cage as a unit; the improvement wherein a line representing the shortest distance between the center of gravity of said pivotal unit and said axis of rotation of said cage is parallel to the axis of said pivotal shaft, whereby any centrifugal force generated by the rotation of said cage and exerted on the pivotal unit has a zero torque about said axis of said pivotal shaft.

2. In a coiling device for depositing sliver in a canister including a rotary cage having an axis of rotation; means for rotating the cage; means defining an inlet opening through which the sliver is introduced into the cage; means defining an outlet opening in the cage eccentrically thereof for discharging the sliver in a path orbiting about the cage axis; a first calender roll supported in the cage; drive means connecting the cage with the first calender roll for rotating the first calender roll about its longitudinal axis upon rotation of the cage about the cage axis; a second calender roll supported in the cage on a pivotal shaft mounted in the cage and spaced from the second calender roll; means for urging the second calender roll against the first calender roll for generating a clamping force; means for driving the second calender roll about its longitudinal axis; the second calender roll and the pivotal shaft forming part of a pivotal unit having a center of gravity; the two rolls constituting a cooperating calender roll pair between the inlet opening and the outlet opening for drawing, by means of the clamping force, the sliver through the inlet opening and advancing it through the outlet opening; the roll pair moving with the cage as a unit; the improvement wherein a line representing the shortest distance between the center of gravity of said pivotal unit and said axis of rotation of said cage intersects the axis of said pivotal shaft, whereby any centrifugal force generated by the rotation of said cage and exerted on the pivotal unit has a zero torque about said axis of said pivotal shaft.

* * * * *